US007730994B2

(12) United States Patent
Meres

(10) Patent No.: US 7,730,994 B2
(45) Date of Patent: Jun. 8, 2010

(54) ACOUSTIC PANEL AND MANUFACTURING METHOD

(75) Inventor: Oskar Meres, Vallensbaek Strand (DK)

(73) Assignee: Rockwool International A/S, Hedehusene (DK)

( * ) Notice: Subject to any disclaimer, the term of this patent is extended or adjusted under 35 U.S.C. 154(b) by 178 days.

(21) Appl. No.: 11/909,255

(22) PCT Filed: Mar. 17, 2006

(86) PCT No.: PCT/EP2006/002487

§ 371 (c)(1),
(2), (4) Date: Dec. 6, 2007

(87) PCT Pub. No.: WO2006/100002

PCT Pub. Date: Sep. 28, 2006

(65) Prior Publication Data

US 2009/0126287 A1 May 21, 2009

(30) Foreign Application Priority Data

Mar. 21, 2005 (EP) ..... 05251704

(51) Int. Cl.

| | |
|---|---|
| ***H05K 5/00*** | (2006.01) |
| ***A47B 81/06*** | (2006.01) |
| ***E04B 1/82*** | (2006.01) |
| ***E04B 2/00*** | (2006.01) |

(52) U.S. Cl. ..... 181/150; 181/199; 181/290; 52/144; 52/145; 52/506.1

(58) Field of Classification Search ..... 181/150, 181/199, 290; 52/506.1, 144, 145
See application file for complete search history.

(56) References Cited

U.S. PATENT DOCUMENTS

| | | | | | |
|---|---|---|---|---|---|
| 3,492,771 | A | * | 2/1970 | Mccartan et al. | 52/506.1 |
| 3,581,453 | A | * | 6/1971 | Jones et al. | 52/506.1 |
| 3,608,264 | A | * | 9/1971 | Mccartan et al. | 52/506.1 |
| 4,428,454 | A | * | 1/1984 | Capaul et al. | 181/290 |
| 4,548,010 | A | * | 10/1985 | Hintsa | 52/506.09 |
| 5,423,151 | A | * | 6/1995 | Caro et al. | 52/145 |
| 5,533,306 | A | * | 7/1996 | Aspenson | 52/144 |
| 6,015,025 | A | * | 1/2000 | McGrath et al. | 181/199 |
| 6,098,743 | A | * | 8/2000 | McGrath | 181/150 |

FOREIGN PATENT DOCUMENTS

| | | |
|---|---|---|
| EP | 0 347 810 A2 | 12/1989 |
| GB | 1 346 988 | 2/1974 |

* cited by examiner

*Primary Examiner*—Jeffrey Donels
*Assistant Examiner*—Christina Russell
(74) *Attorney, Agent, or Firm*—Dickstein Shapiro LLP

(57) ABSTRACT

An acoustic panel (1) has a recess (8) extending part or all way down to a facing (7). A panel loudspeaker (11) may be fixed in the recess or a water sprinkler (14) or other device may be mounted in or above the recess.

26 Claims, 3 Drawing Sheets

Figure 1
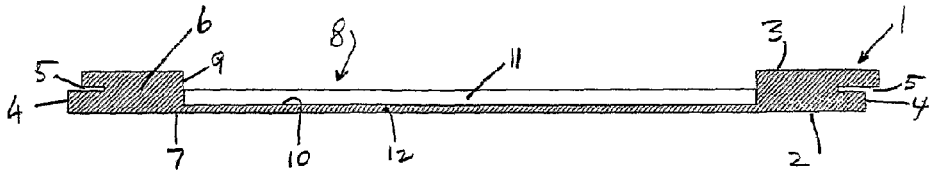
Figure 2
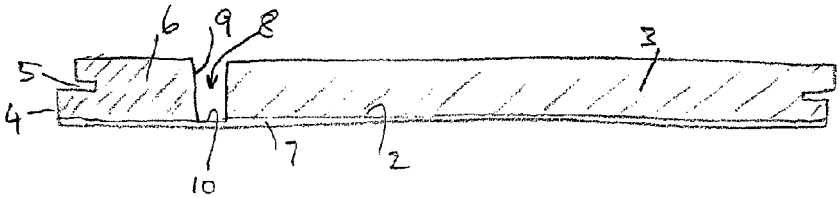
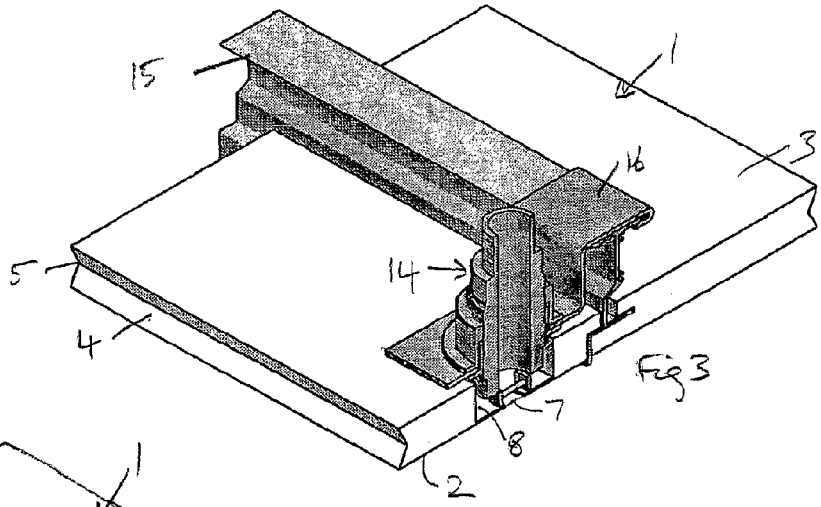
Fig 3
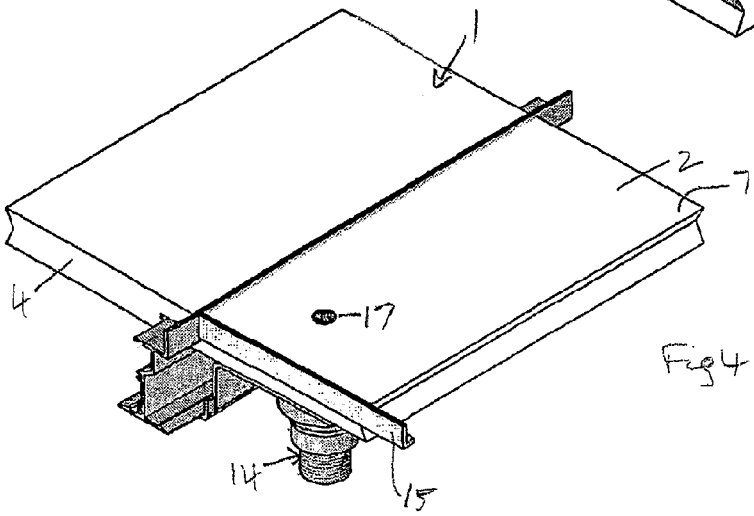
Fig 4

Figure 5 (free standing)
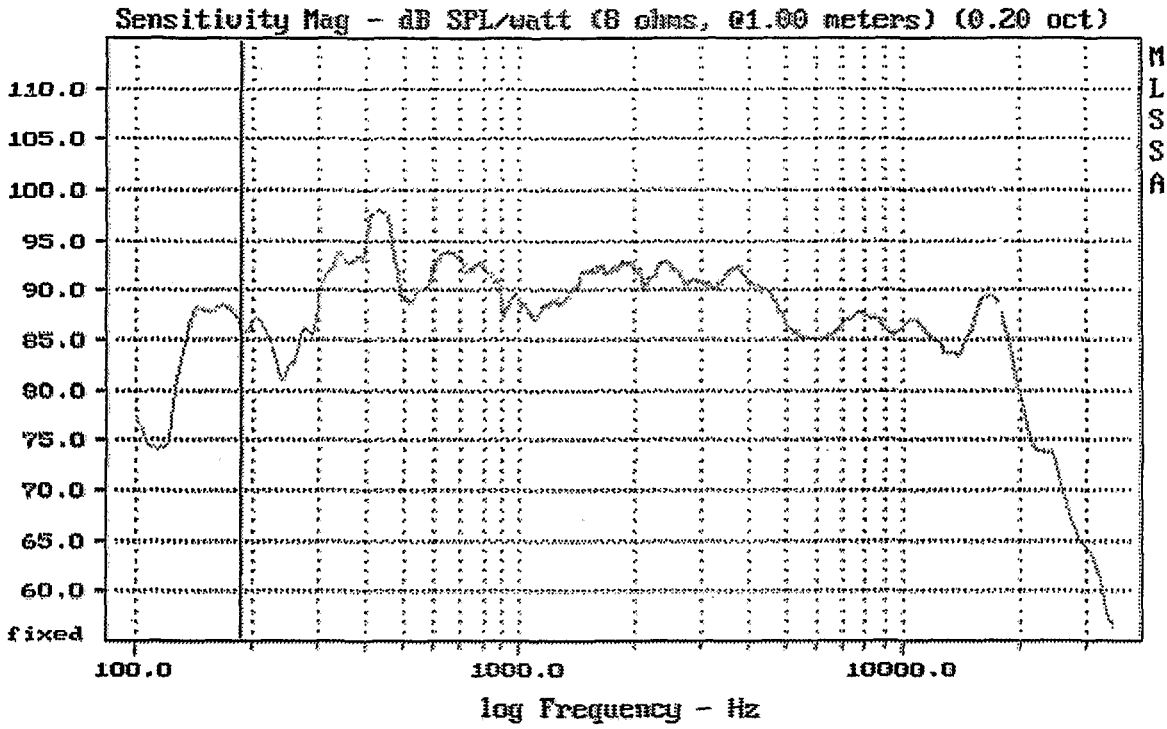

Figure 6 (20mm web 12)
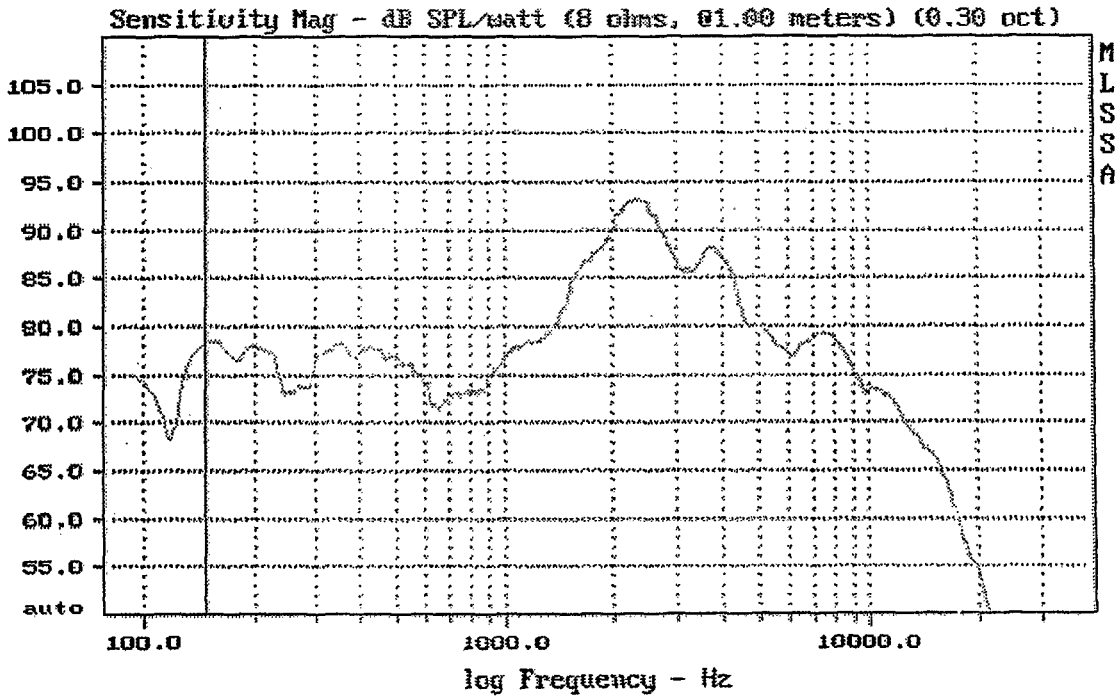
Figure 7 (2 or 3mm web 12)
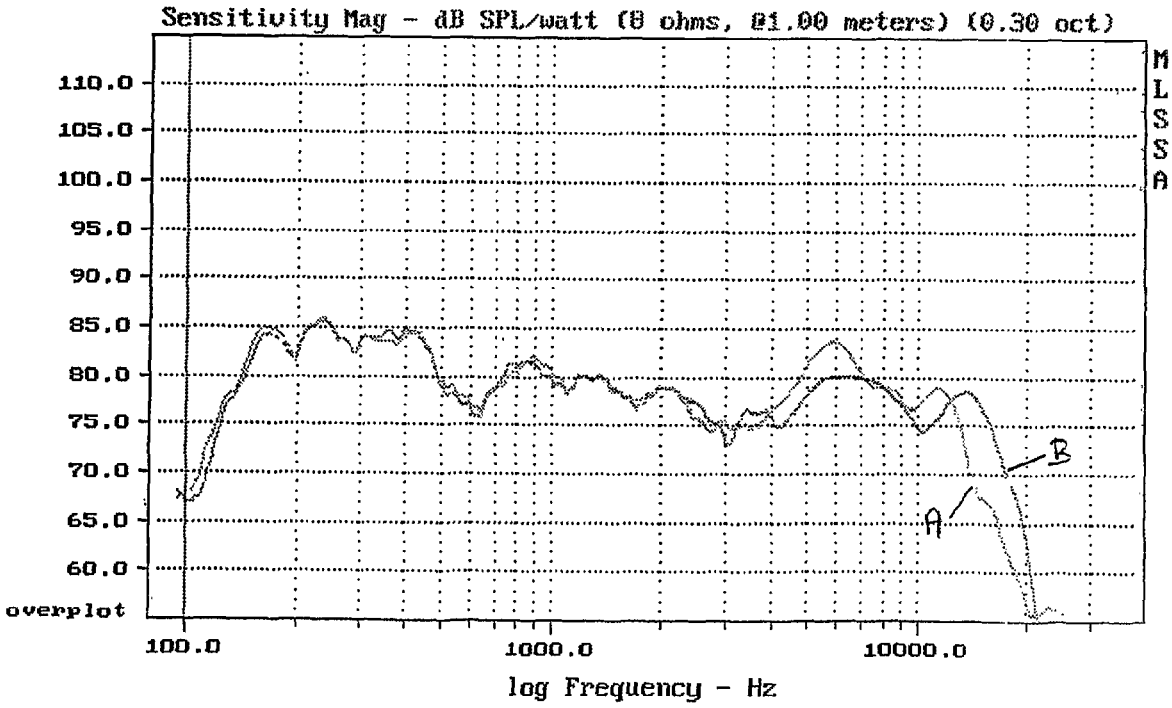

ACOUSTIC PANEL AND MANUFACTURING METHOD

BACKGROUND

The present invention relates to acoustic panels, such as ceiling tiles, of the type which have a body of acoustic (i.e. sound absorbing) material and a facing which forms the front face of the panel.

Panels of this type are widely used to provide the visible face of walls or ceilings of rooms or other enclosed spaces such as in offices, factories, domestic homes and public buildings. The panels are mounted as a panel assembly on a grid, for instance by intermeshing of grooves in the edges of the panels with the grid. It is often desirable that the appearance of the wall or ceiling should be created predominantly by a pleasing appearance of the front face of the tiles and should be free of objects which harm its appearance. It is therefore usually desirable that the face of each panel should be flat and it is often desirable that the overall appearance of the wall or ceiling should be as monolithic as possible, that is to say the entire wall or ceiling should appear as flat as possible, with the minimum visibility of joins, in order to simulate the appearance of a conventional plastered wall or ceiling.

It is, however, desirable to locate various devices on or in the surfaces of walls or ceilings. Examples of such devices include lighting units, water sprinklers, sensors for various purposes, surveillance cameras, and loudspeakers. If such devices are fitted on a panel or in a panel they disrupt the appearance of the panel and, if the surface would otherwise be monolithic, they disrupt the appearance of the monolithic surface.

Panel loudspeakers (for instance as described in US 2003/0031331 and EP-A-1,185,134 and typically available commercially under designations such as NXT from the Martin Group in Denmark) can desirably be mounted on a wall or ceiling, but they can then impair the appearance of the wall or ceiling.

EP-A-1,185,134, addresses the problem of providing a panel loudspeaker that can be situated in a ceiling assembly. It proposes replacing an entire ceiling tile from the grid of ceiling tiles with a speaker and covering the speaker with a facing that is visually similar to the surrounding ceiling tiles. This system has the disadvantage that, for any particular ceiling assembly, the loudspeaker needs to be approximately the same size as the ceiling tile which it places. This means that the panel loudspeaker size is dictated by size of the panels in the ceiling or wall into which it is to be filled. Furthermore, a frame must be provided around the loudspeaker to secure the loudspeaker to the grid. Additionally, facing must be provided over the loudspeaker and which must have an appearance that matches the facing of the panels in the assembly.

There exists a need to provide a convenient way of incorporating a speaker of any size (which can therefore be optimised for reasons unrelated to its ultimate position) into an assembly of panels without disrupting the appearance of the ceiling or walls.

Fire protection systems usually comprise a network of sprinklers which extend down from the face of a ceiling and each of which is activated by a temperature sensor. The temperature sensor can be a glass bulb or other device which is part of the sprinkler and which ruptures when the temperature increases so as to actuate the sprinkler, or it can be a separate sensor. A water supply is typically provided above a ceiling assembly and feeds the sprinkler when it is activated. The sprinklers are usually fixed between 20 and 40 mm below the front or visible surface of the ceiling tile and when the temperature sensor senses an increase in temperature indicative of a fire, it will activate the water supply which will be provided through the sprinkler to extinguish the fire.

Water sprinkler systems of this type have the disadvantage that the water sprinklers and temperature sensors are visible from the room, hence disrupting the appearance of the ceiling, and are considered by many people to be unsightly. The exposed water sprinklers are also frequently subjected to vandalism. It is known to mount the sprinkler, when inactive, very close to the ceiling and to arrange for the sprinkler to drop down from the ceiling, by 1 to 5 cm, when activated before water spraying is initiated. However the sprinklers are still clearly visible and disrupt the appearance of the facing of the tiles.

U.S. Pat. No. 3,246,432, addresses the problem of concealing heat sensitive sprinklers in a suspended ceiling by providing a heat softenable ceiling grid and locating the sprinklers above the ceiling tiles which are positioned in the grid. When the temperature rises to a predetermined level, the grid softens and deforms sufficiently to permit the ceiling tiles to drop out of the grid. This exposes the thermosensitive sprinkler heads which then detect the elevated temperature and begin to spray water. In U.S. Pat. No. 4,189,888 the fire sprinklers are mounted above plastic tiles and the sprinklers are exposed only when the tiles are burnt.

Systems such as these are undesirable because of the injury and damage that can be caused by the melting or the burning of the tiles and because of the inevitable delay between the increase in temperature in the room and the initiation of sprinkling. It would therefore be desirable to provide a ceiling assembly which contained sprinklers which did not suffer from these disadvantages.

Sensors, such as intruder alarms, surveillance cameras, lighting and other devices can all desirably be provided but at present they all suffer from the disadvantage that their effectiveness is reduced or destroyed if they are concealed by the panel, but the appearance of the ceiling or wall is harmed if they are not concealed by the panel.

DETAILED DESCRIPTION

The invention has the objective of providing panels, and ceiling and wall assemblies containing such panels, having a desired monolithic or other pleasing appearance of conventional assemblies but which allow various functions to be provided in a more efficient and visually satisfactory manner than previously.

The present invention provides an acoustic panel having a front face, a reverse face and edge faces, an edge region leading inwardly from the edge faces and a central region surrounded by the edge region, wherein the panel-comprises a body having thickness T of acoustic material, and a facing which forms the front face of the panel and covers the front of the body, characterised in that the panel has a recess formed in the central region of the reverse face, wherein the recess has side walls and a base and has a depth D where D is at least 0.5T.

The acoustic panels can be incorporated into a grid and used in an assembly as a false wall or suspended ceiling in conventional manner. The front face is the face which is visible from the room or other enclosed space when the panel is in such an assembly, and the reverse face is opposite the front face and so is not visible from the enclosed space.

The edge faces of such panels can have grooves which allow them to be held in the grid in a known fashion. The edge region is often reinforced, for instance by additional resin, in order to strengthen grooves in the edge region, in conventional manner. The edge region is the region which leads inwardly from the edge faces and makes up the part of the panel which contains the grooves or other features associated with assembly in a grid. The central region is the remainder of the panel surrounded by the edge regions and comprises a majority of the panel, usually at least 60% and usually at least 75% of the total area of the panel. It can extend up to very close to the edges, so that it embraces, for instance, 99% of the area of the panel but the central region is usually not more than 90 or 95% of the total area of the panel.

The panel has a recess with side walls and a base formed in the central region of the reverse face. In the context of the invention, a recess is a cavity extending into but not through the panel. Accordingly, the recess never extends through the facing and may extend partially or completely through the body. The recess depth D is at least 0.5 T so that the recess extends through at least half of the thickness of the body of the panel. Preferably the recess depth D is at least 0.75 T, more usually at least 0.80 T, 0.85 T or 0.90 T. As explained below, in some embodiments of the invention the recess extends through the thickness T, so that it extends through the entire body of the panel but it does not extend through the facing.

The present invention is advantageous as it allows for a device to be located in or above the recess where it can be concealed from view. As there is a reduced thickness of total material (body plus facing or facing alone) between the device and the front face of the panel the device can have a normal visual effect when viewed from within the room.

The body of the panel is formed of acoustic material and can be any material having sound absorbing properties. The body is preferably mineral wool or bonded inorganic particulate material such as gypsum, and is most preferably rock wool or glass wool.

The thickness of the body, T, is in the "Z" or thickness direction between the front face and reverse face of the panel. A facing is provided which is substantially or wholly coextensive with the body and forms the front face of the panel. The facing is substantially continuous to give a mainly uniform appearance to the panel. The facing can be conventionally made of a woven fabric, non-woven fabric or film, and is most preferably a bonded non-woven fabric, often made of glass or other mineral fibres bonded by an organic polymeric binder which is usually film forming.

Alternatively, the facing may be a decorative layer such as a layer of paint. Decorative layers may not be self-supporting (i.e. may not remain substantially flat over the recess if they are not attached to the body material). Therefore, it is not appropriate to use such layers as a facing where the recess extends down to the facing as in the second embodiment of the invention, as described below.

The body thickness T is usually conventional and is preferably between 10 and 70 mm, most preferably between 15 and 25 mm which makes the panel ideal for use as a ceiling tile. The facing thickness (also in the direction between the front and reverse faces of the panel) is preferably between 0.1 and 5 mm, most preferably between 1 and 3 mm. When the panel is designed to be suitable for use as a wall tile, the body thickness T is preferably 40 to 50 mm.

There are two main embodiments of the present invention. In the first, a panel loudspeaker is positioned in the recess and the recess extends through at least half but not through all of the thickness of the body of the panel.

In the second embodiment, the recess extends substantially through the entire thickness of the body, down to but not through the facing. The facing is generally a woven or non-woven fabric or a film. A device such as a camera, sensor, illuminator, air conditioner, ventilator or sprinkler can be mounted in or above the recess.

The embodiments of the invention are illustrated in the drawings.

BRIEF DESCRIPTION OF THE DRAWINGS

FIG. 1 shows a cross sectional view of a panel according to a first embodiment of the present invention;

FIG. 2 shows a cross sectional view of a panel according to a second embodiment of the present invention;

FIGS. 3 and 4 show perspective views from above and below respectively of a panel according to a second embodiment of the invention; and FIGS. 5 to 7 are graphs showing the sound from a loudspeaker in various positions at a range of frequencies.

DETAILED DESCRIPTION OF THE DRAWINGS

Referring to FIG. 1, a ceiling tile 1 has a front face 2 and a rear face 3 and edge faces 4 in which grooves 5 are provided for mounting the panel in an appropriate grid to form a panel assembly. The panel consists of a body 6 of mineral wool or other sound insulating material having a facing 7 (not shown separately) bonded to the front face 2. The body has a thickness T. A recess 8 having a depth D is provided in the rear face 3 of the panel and is defined by sidewalls 9 and a base 10. A thin web 12 of the sound insulating material extends between the base of the recess and the facing 7 and has a thickness T-D. A loudspeaker panel 11 fits within the recess. The panel usually has a depth the same as or less than D, but this is relatively unimportant since the reverse face is not visible through the tile and so the panel can, if desired, have a depth greater than D.

Any type of loudspeaker which is in the form of a panel can be used. Flat panel loudspeakers are known in the art and usually incorporate technology whereby, upon excitation, a wave is produced in the loudspeaker panel which causes sound energy to be radiated from the faces of the loudspeaker. The loudspeaker typically has dimensions in the XY direction (i.e. in the plane of the panel) which are substantially the same as the dimension of the recess. If the panel is smaller than the recess, then it is desirable to provide a spacer of insulating material or other material to provide packing between the edges of the panel and the side walls of the recess.

The maximum dimensions of the recess are usually at least 100 mm and often at least 200 mm or 300 mm and generally at least 400 mm. When the panel is a ceiling tile, the area of the recess is often at least 20% of the area of the tile and may be as much as 50% or even 80 or 90% of the area of the tile.

It might have been thought that providing the panel speaker behind a web 12 of sound absorbing material would deleteriously impair the perceived acoustic qualities of the loudspeaker panel, when assessed by someone inside the room which is defined by the ceiling tile or wall panel assembly. Merely providing a panel loudspeaker behind conventional acoustic panels does have a serious deleterious impact on the perceived sound quality in the room. If the entire depth of sound absorbing material is removed, so that the loudspeaker panel is in direct contact with the facing, there is then a serious adverse effect upon the visual appearance of the panel.

In the invention, we surprisingly find that it is possible to maintain a web 12 of sound absorbing material between the loudspeaker panel and the facing wherein the web has no substantial deleterious impact on the perceived acoustic properties of the loudspeaker panel and yet substantially allows maintenance of the visual appearance of the front facing, substantially as if the panel was a conventional panel without a recess in it.

Nevertheless, since the web 12 is weaker than the remainder of the body of the panel, the panel is potentially weakened by the provision of the recess both against distortion in the XY direction and distortion in the Z (or thickness) direction.

In order to minimise, and indeed prevent, distortion in the XY direction the loudspeaker panel should preferably make a tight fit with the walls 9 of the recess or, if it does not, an appropriate spacer element should preferably be provided between the edges of the loudspeaker panel and the walls 9 of the recess so as to provide a tight fit. Additionally, there should preferably be secure bonding around the walls 9 to the edges of the panel, or to the edges of the spacer and between the spacer and the panel, and this is preferably done by providing a curable polymeric sealant around the appropriate edges so that the panel loudspeaker and the walls 9 form a rigid assembly to prevent distortion of the panel in the XY direction. A suitable sealant is an MS polymer. Alternatively, mechanical means may be used to provide a tight fit, for example a Z-profile spacer that provides a tight fit between the panel and the side walls.

It is also desirable to bond the web 12 to the lower face of the panel loudspeaker both to prevent the web 12 distorting in the Z direction and to improve acoustic performance. It seems that, when the thickness of the web is appropriate, bonding of the web to the face of the loudspeaker panel tends to result in the web vibrating with the loudspeaker panel as sound is radiated from the front face of the panel. A suitable contact adhesive such as PVA glue or PUR glue can be used to bond the face of the loudspeaker panel to the base 10 of the recess.

The body 6 of the panel 1 is an acoustic material. The acoustic material (for example rock wool or glass wool) preferentially absorbs sounds at high frequencies, particularly above about 10 kHz. Low frequencies (for instance below 250 Hz) are more easily transmitted through a wool material. The range of human hearing can extend up to about 20 kHz but deteriorates with age but it is generally desirable that substantially all the sound up to about 15 or 16 kHz is transmitted through the web. Any loss at higher frequencies is relatively unimportant and can be compensated by appropriate tuning of the loudspeaker panel.

The graphs in FIGS. 5 to 7 compare the sound transmitted from a loudspeaker that is standing alone (FIG. 5), with the same loudspeaker which is positioned in a recess in different panels according to this embodiment of the present invention. The graphs are not directly comparably but show the trend of a reduction in high frequency sound with increased thickness. The high frequency part of the graph (above 10 KHz) is important for the present invention. It is known (as shown clearly in FIG. 6) that acoustic material has peaks and troughs in it's sound absorption at various frequencies. This irregular absorption at various frequencies below 10 KHz can be compensated for by modifying the loudspeaker output for example by means of a tuner or passive frequency divider. Such techniques are well known to people skilled in this art.

FIG. 5 shows the sound of a loudspeaker standing alone, i.e. with only air between it and the microphone and is in a support which holds it upright. The microphone is positioned 1 meter away from the loudspeaker. The important part of the graph is the behaviour at high frequencies. It can be seen that the loudspeaker itself has a high level of sound output up to about 20 KHz (where the sound is 80 db). Above this frequency, the sound drops off sharply.

FIG. 6 shows the loudspeaker positioned in a recess in a panel wherein the thickness of body material at the base of the recess (T-D) is 20 mm. This shows rapid deterioration of sound above about 12 KHz. This is generally considered to be unacceptable. It can also be seen from this graph that the panel generates peaks and troughs at certain frequencies (for example, with this panel, there is a peak between 2 and 3 kilohertz). The primary area of concern for the present invention is the loss of sound at high frequencies.

FIG. 7 shows a graph having two sets of results plotted on it labelled A and B. Both sets of results are for a loudspeaker fitted in a recess in a panel according to the present invention. In the first panel (the results labelled A) the thickness of web material at the base of the recess (T-D) is 3 mm. In the second product (plot labelled B) the thickness of web material at the base of the recess (T-D) is 2.5 mm. This graph shows that when the sound has to travel through an increased thickness of material (3 mm compared to 2 mm) the high frequency sound is reduced.

The thicker the web 12 of acoustic material 6 at the base 10 of the recess 8, the less able the material is to move with the face of the loudspeaker, so the more sound will be absorbed and the more the high frequency sound will be cut out almost entirely by the material. Therefore, in terms of sound absorption, the web 12 of acoustic material 6 at the base 10 of the recess 8 should be thin (so T-D should be small). However, if the web is too thin, the appearance of the lower face is impaired.

The thickness of the web 12 of acoustic material 6 at the base of the recess 8 can be selected through experimentation and should be thick enough to ensure that front face is not distorted and that the loudspeaker is not visible from the front face 2, but thin enough to provide a good sound quality, particularly below 16 Hz. Such experimentation can identify peaks and troughs in sound absorption by the acoustic material and modifications to the loudspeaker output can be made by adjustment of a tuner in order to counteract the effect of the material. Such modifications are known to a person skilled in the art.

Preferably, the thickness T-D of acoustic material 6 is such that it does not substantially absorb frequencies below 16 kHz.

It has been found that, using a panel of many acoustic materials, including mineral wool (especially rockwool), when the thickness of the web 12 in the region of the recess (T-D) is less than about 1.5 mm, it may be possible to see the loudspeaker 11 from the front face 2 of the panel 1 and it will be difficult to maintain a flat facing and to obtain sufficient support for the loudspeaker. When the thickness of the web 12 is greater than about 5 mm, an undesirable proportion of the high frequency sound will be absorbed by the material 6 rather than being transmitted through it. Therefore, the thickness of the body 6 at the base 10 of the recess 8 is preferably between 1.5 and 5 mm, more preferably between 2 and 3 or 4 mm.

By situating the loudspeaker 11 in a panel itself, the present invention has many advantages with respect to the prior art. For example, speakers of any size can be situated in a ceiling or wall assembly provided that the panels are larger than the speakers. As the speaker is located in the panel itself, no additional materials are needed to cover the loudspeaker as the only surface visible from the room is the facing of the panel and hence there is no disruption in the appearance of the ceiling or wall.

The panel 1 having a loudspeaker 11 positioned therein can be positioned in a grid 13 as part of a false wall or suspended ceiling. In particular, such a panel can be a ceiling tile positioned in a grid forming a ceiling assembly.

The present invention also provides a method of making a panel 1 according to the first embodiment of the invention. This method comprises the steps of a) providing an acoustic panel 1 having a front face 2, a reverse face 3 and edge faces 4, an edge region 5 leading inwardly from the edge faces and a central region surrounded by the edge region, wherein the panel comprises a body 6 having thickness T of acoustic material, and a facing 7 which forms the front face of the panel and covers the front of the body;

b) forming a recess 8 in the central region of the reverse face, wherein the recess has side walls 9 and a base 10 and has a depth D where D is at least 0.5 T;

c) positioning a panel loudspeaker 11 in the recess as a tight fit; and d) bonding the loudspeaker to the recess 8, to both the bottom face of the recess and the edges of the recess.

Preferably, the recess is formed by grinding. Generally the recess is formed while the panel is held on a support surface to prevent distortion of the web 12 and the loudspeaker panel is inserted in the recess, and secured both to the side walls and the base of the recess, while the panel is still held on the same support surface. This avoids the need to move the panel while it is weak due to the presence of the recess. For instance the panel may be held on the support surface by vacuum until the panel loudspeaker has been tightly fitted into the recess, whereupon the panel can be handled in conventional manner.

A preferred ceiling or wall assembly will also include a low frequency loudspeaker (for instance for sound below 250 Hz or, especially, below 150 Hz) mounted behind the wall or ceiling panels in conventional manner. This improves the quality of the sound received in the room since the loudspeaker does not have to be a panel loudspeaker (and so can be optimised for low frequencies) and its low frequencies are not absorbed by the full thickness of the panels.

The panel can then be fitted in a ceiling assembly or wall assembly in conventional manner. The visual appearance of the panel, on its face side, will be indistinguishable from the appearance of the other panels in the assembly and yet the sound quality generated by the loudspeaker panel will be indistinguishable (possibly after minor tuning of the loudspeaker panel) from the sound quality that would have been perceived if the loud speaker had been mounted on the visible face of the wall or ceiling.

According to the second embodiment of the invention, the recess 8 extends substantially down to but not through the facing 7. Such a panel is shown in FIG. 2.

In this embodiment the recess 8 is usually relatively small in comparison with the size of the panel 1 and typically comprises 1% to 20% of the area of a ceiling tile, often less than 10% of the area of the panel 1. In particular, the dimensions of the recess in the XY plane are usually not more than 100 mm or, in some instances, up to 150 or 200 mm, and most usually are not more than 50 or 80 mm. They are usually at least 5 mm and often at least 10 mm. Preferred dimensions are often between 20 and 60 mm. The recess is usually substantially circular in the XY direction, but can be rectangular or other desired shape. The recess usually 8 extends through the entire thickness of the body 6 but does not extend through the facing 7. Although the recess 8 could be in any position in the panel, it is generally desirable for it to be in the central region so as to avoid interfering with the groove or other components in the edge regions.

Because the dimensions of the recess are small relative to the tile or panel, it is easily possible to select a fibrous or film facing material 7 which has sufficient coherence and strength that the absence of any acoustic material behind the facing in the area of the panel will not significantly, or at all, impair the visual appearance of the panel in the panel assembly.

In this embodiment, a device such as a camera, sensor, illuminator, air conditioning supply or sprinkler is provided in or above the recess 8. The device may then act through the facing 7 to the room as if it was mounted on the panel itself rather than behind it. This has the advantage over conventional systems where a device is merely mounted on or below the surface of a ceiling or wall in that the device is not visible from the room.

In particular, where the device is a camera, sensor or illuminator, it may be mounted in or behind the recess 8 and oriented to record, sense or illuminate on the facing side of the panel 1. When the device is included in a panel in an assembly, the device may be mounted in or or above the recess by means of a mounting attached to the grid. In this case it is convenient to position the recess close to the edge of the panel (for example up to 5 or 10 cm from the edge). The only limit is that the recess is in the central region which means that it is not in the edge region which contains grooves associated with mounting the panels on a grid.

When the device is an illuminator, the recess may be elongated, for instance having a length of at least 100 mm, 200 mm or 400 mm, and a width which is less than 50%, often 5 to 20%, of its length. The width is usually at least 20 mm and often at least 50 mm.

When it is necessary to provide direct optical or other contact through the facing, it may be necessary to provide an aperture 17 through the facing 7 leading into the recess 8. The aperture will be small compared to the recess and in particular should have a largest transverse dimension of below 15 mm, preferably below 10 mm, most preferably 1 to 5 mm. Because it is so small, it will not impair significantly, or at all, the visual appearance of the panel in the panel assembly. Alternatively, however, it may be desirable to make a design feature of the small aperture, for instance by providing a decorative relatively shallow ring around it. This has the advantage of subsequently facilitating location of the aperture if this is necessary for any purpose.

As the aperture 17 is small, it is not easily visible from the front face 2 of the panel 1 and the facing 7 is still substantially continuous and is still able to give a largely uniform appearance.

Where an aperture 17 is provided, the sensitive part of the device, such as the lens of the camera or sensing part of the sensor is placed above the aperture so that it can effectively work through the front face 2 of the panel 1. The bulky part of the device can be situated in or above the recess 8 so as to be concealed from view from the front face 2 of the panel 1.

When the panels 1 are used in part of a ceiling assembly, illuminators or air conditioning supplies may be provided above the panels so as to direct light or air through the facing 7 in the base 10 of the recess 8. Hence, lighting or air conditioning may be provide from units which are situated above the ceiling by making use of the reduced thickness of the panel 1 in the region of the recess 8.

A preferred aspect of the second embodiment is illustrated in FIGS. 3 and 4 of the drawings and provides a ceiling assembly wherein one or more ceiling tiles comprises a panel 1 having a recess 8, the assembly additionally comprising a water sprinkler 14 and a temperature sensor for activating the sprinkler. For simplicity, in FIGS. 3 and 4 the housing only of the water sprinkler is shown (in broken cross-section in FIG. 3). The detailed construction of the sprinkler can be conventional.

FIGS. 3 and 4 show the sprinkler 14 suspended by a bracket 16 from part of the grid 15 which supports the tile or other panel assembly and which fits into the recess 8 in the panel.

The sprinkler 14 is mounted in or above the recess 8 for dropping through the recess and facing 7 when activated. The mechanism by which the sprinklers are capable of dropping on activation is known in the art. The sprinkler usually drops by a predetermined distance so that after activation it protrudes from the front face 2 of the panel 1 a distance of between 10 and 50 mm, preferably 30 to 45 mm. The sprinkler preferably comprises cutting means (such as a sharp edge around its base) for rupturing the facing 7 when the sprinkler drops.

To ensure that the sprinkler 14 can drop through the facing easily, the facing over the recess may be weakened instead of or in addition to the provision of cutting means. Preferably this is achieved by providing perforations so that, on activation, the sprinklers drop down and pass through the perforated area of facing. The perforations are small holes which are not easily visible and the facing is still substantially continuous.

The temperature sensor which activates the sprinkler can be located in or above a passage through the facing over the recess (i.e. a small aperture 17 through the facing 7 leading into the recess 8) or in or above a passage through the thickness of the panel. Such a passage may be provided in the central region of the panel (or even in the edge region) and will have transverse dimensions which are the same as the aperture described above (provided leading into the recess). Alternatively, the temperature sensor may be mounted on the front face 2 of the assembly, preferably between the edge face 4 of the panel 1 and the grid 15.

In this way, the temperature sensor is able to quickly sense any change in temperature at the front face 2 of the panel 1 and activate the sprinkler 14 accordingly.

Providing a concealed sprinkler 14 is advantageous with respect to conventional systems as the effectiveness and reliability of the sprinkler is not compromised by its concealment.

The invention claimed is:

1. An acoustic panel having a front face, a reverse face and edge faces, an edge regions leading inwardly from the edge faces and a central region surrounded by the edge region, wherein the panel comprises a body having thickness T of acoustic material, and a facing which forms the front face of the panel and covers the front of the body, characterised in that the panel has a recess formed in the central region of the reverse face, wherein the recess has side walls and a base and has a depth D where D is at least 0.5T, and in which a panel loudspeaker is positioned in the recess as a tight fit with the side walls and is oriented towards, and is bonded to the base of the recess.

2. A panel according to claim 1 in which the body is an acoustic body of mineral wool or bonded inorganic particulate material and, the facing is a layer of paint, a woven fabric, a non-woven fabric or a film.

3. A panel according to claim 1 in which the body is of rock wool or glass wool and/or the facing is a non-woven fabric.

4. A panel according to claim 1 wherein the body thickness T is between 10 and 70 mm, and the facing thickness is between 0.1 and 5 mm.

5. A panel according to claim 1 wherein the recess extends partially through the body.

6. A panel according to claim 1 wherein the tight fit of the loudspeaker with the walls of the recess is provided by a sealant between the walls of the recess and the loudspeaker.

7. A panel according to claim 1 in which the thickness T-D of acoustic material at the base of the recess is T-D and does not substantially absorb frequencies below 16 kHz.

8. A panel according to claim 1 wherein the thickness of acoustic material at the base of the recess is between 1.5 and 5 mm.

9. A panel according to claim 1 wherein the recess is obtainable by grinding.

10. A ceiling assembly comprising a grid having acoustic ceiling tiles positioned in the grid wherein one or more ceiling tiles comprises a panel according to claim 1.

11. A method of making a panel according to claim 1, the method comprising the steps of:

a. providing an acoustic panel having a front face, a reverse face and edge faces, an edge region leading inwardly from the edge faces and a central region surrounded by the edge region, wherein the panel comprises a body having thickness T of acoustic material, and a facing which forms the front face of the panel and covers the front of the body;

b. forming a recess in the central region of the reverse face, wherein the recess has side walls and a base and has a depth D where D is at least 0.5T;

c. positioning a loudspeaker in the recess as a tight fit; and d. bonding the loudspeaker to the recess, to both the bottom face of the recess and the edges of the recess.

12. A ceiling assembly comprising a grid having acoustic ceiling tiles positioned in the grid, a water sprinkler and a temperature sensor for activating the sprinkler, wherein the sprinkler is mounted in or above the recess for dropping through the recess and facing when activated, and the temperature sensor is located in or above a passage through the facing over the recess or through the thickness of the panel or is mounted on the front face of the assembly and wherein one or more ceiling tiles comprises a panel having a front face, a reverse face and edge faces, edge regions leading inwardly from the edge faces and a central region surrounded by the edge region, wherein the panel comprises a body having thickness T of acoustic material, and a facing which forms the front face of the panel and covers the front of the body, characterised in that the panel has a recess formed in the central region of the reverse face, wherein the recess has side walls and a base and has a depth D where D is at least 0.5T, wherein the recess extends substantially down to but not through, the facing and the facing is a woven or non-woven fabric.

13. An assembly according to claim 12 in which the transverse dimensions of the recess are below 200 mm.

14. An assembly according to claim 12 in which the facing has an aperture leading into the recess and having transverse dimensions of below 10 mm.

15. An assembly according to claim 12 having a camera or sensor or illuminator mounted in the recess and oriented to record or sense or illuminate on the facing side of the panel.

16. An assembly according to claim 12 having illuminators, or air conditioning supplies or ventilation supplies above the panels disposed so as to direct light or air through the facing in the base of the recess.

17. An assembly according to claim 12 wherein the sprinkler comprises a cutter for rupturing the facing when the sprinkler is activated.

18. An assembly according to claim 12 wherein the facing over the recess is weakened.

19. An assembly according to claim 12 in which the body is of rock wool or glass wool.

20. An acoustic panel having a front face, a reverse face and edge faces, edge regions leading inwardly from the edge faces and a central region surrounded by the edge region, wherein the panel comprises a body having thickness T of acoustic material, and a facing which forms the front face of the panel and covers the front of the body, characterised in that the panel has a recess formed in the central region of the reverse face, wherein the recess has side walls and a base and has a depth D where D is at least 0.5T, wherein the body is an acoustic body of mineral wool, and wherein the recess extends partially through the body and is obtainable by grinding, and the facing is a layer of paint, a woven or a non-woven fabric, and in which a panel loudspeaker is positioned in the recess as a tight fit with the side walls and is oriented towards, and is bonded to the base of the recess.

21. A panel according to claim 20 in which the body is of rock wool or glass wool and/or the facing is a non-woven fabric.

22. A panel according to claim 20 wherein the body thickness T is between 10 and 70 mm, and the facing thickness is between 0.1 and 5 mm.

23. A panel according to claim 20 wherein the tight fit of the loudspeaker with the walls of the recess is provided by a sealant between the walls of the recess and the loudspeaker.

24. A panel according to claim 20 in which the thickness of acoustic material at the base of the recess is T-D and does not substantially absorb frequencies below 16 kHz.

25. A panel according to claim 20 wherein the thickness of acoustic material at the base of the recess is between 1.5 and 5 mm.

26. A ceiling assembly comprising a grid having acoustic ceiling tiles positioned in the grid wherein one or more ceiling tiles comprises a panel according to claim 20.

* * * * *